United States Patent [19]

Midorikawa

[11] 4,287,146

[45] Sep. 1, 1981

[54] NIB-TYPE WRITING PEN AND METHOD OF MANUFACTURE

[76] Inventor: Yoshio Midorikawa, 1-8-1 Nishigahara, Kita-ku, Tokyo, Japan

[21] Appl. No.: 949,040

[22] Filed: Oct. 6, 1978

[30] Foreign Application Priority Data

Oct. 11, 1977 [JP] Japan ..... 52-120965

[51] Int. Cl.[3] ..... D04H 1/64; D04H 1/74; B43K 1/12; D04H 3/12

[52] U.S. Cl. ..... 264/128; 156/296; 156/305; 264/136; 264/150; 264/174; 401/198; 427/221; 428/295

[58] Field of Search ..... 156/166, 180, 250, 244.11, 156/244.12, 244.13, 296, 305; 401/196, 198, 199, 195, 202; 264/129, 134, 136, 137, 148, 150, 151, 154, 157, 173, 174, 128, 261, 263, 177 R, 259; 118/408; 427/238, 221; 428/295

[56] References Cited

U.S. PATENT DOCUMENTS

| | | | |
|---|---|---|---|
| 3,178,770 | 4/1965 | Willis | 264/177 R |
| 3,342,162 | 9/1967 | Priaroggia et al. | 118/408 |
| 3,374,767 | 3/1968 | Baskwell | 118/40 |
| 3,442,002 | 5/1969 | Geary et al. | 264/258 |
| 3,714,314 | 1/1973 | Davidson | 264/137 |
| 3,733,246 | 5/1973 | Thomson et al. | 156/244.12 |
| 3,767,520 | 10/1973 | Dick | 401/198 |
| 3,864,183 | 2/1975 | Hori | 156/180 |
| 4,086,312 | 4/1978 | Midorikawa | 264/128 X |
| 4,104,781 | 8/1978 | Midorikawa | 264/136 X |
| 4,119,756 | 10/1978 | Midorikawa | 264/128 X |

*Primary Examiner*—Philip Anderson

*Attorney, Agent, or Firm*—Lane, Aitken, Ziems, Kice & Kananen

[57] ABSTRACT

A nib-type writing pen is formed by compressing a plurality of fibers into a bundle, extruding a plastic sheath around the fiber bundle, cutting the sheathed fiber bundle to a suitable length and injecting a urethane prepolymer into one or both ends of the cut and sheathed fiber bundle.

6 Claims, 5 Drawing Figures

NIB-TYPE WRITING PEN AND METHOD OF MANUFACTURE

BACKGROUND OF THE INVENTION

The manufacture of an integral writing nib and ink reservoir is disclosed in my own U.S. Pat. Nos. 4,086,312, 4,104,781 and 4,119,756. However, in the method of the above patents the formation of the hard pen nib portion is performed by the step of dipping either or both ends of the pen material into liquid urethane prepolymer to impregnate urethane prepolymer into the fiber bundle portion and hardening the urethane prepolymer filled portion by the reaction of urethane prepolymer constituents after removal from the urethane prepolymer liquid.

However, when in this method the sign pen material is dipped into urethane prepolymer liquid the sheath portion is also dipped into liquid, which results in poor appearance and workability of the pen in the later finishing processes. Furthermore, this reduces considerably the rate at which the pens may be mass-produced in a continuous manner.

SUMMARY OF THE INVENTION

Accordingly, the present invention has for its object to provide method for continuous large scale manufacture of a nib pen with an integral ink reservoir without dipping the pen material into urethane prepolymer liquid.

Another object of the present invention is to provide a method of manufacturing a nib pen in a much shorter time than previously required in assembly of parts by means of injecting urethane prepolymer under pressure into the fiber bundle.

The still another object of the present invention is to provide a method of manufacturing a nib pen by the steps of forming at least one axially linear or spiral groove as an air passage within the thickness of the sheath during the extrusion of the sheath, and thereafter injecting urethane prepolymer under pressure.

According to the present invention, the above objects are achieved by manufacturing a nib pen with a completely integral pen nib portion and ink reservoir comprising the steps of passing fibers through a die to compress and form them into a predetermined shape of a fibre bundle, extruding a sheath to coat said fiber bundle, cutting the sheathed fiber bundle thus formed, and injecting pressurized urethane prepolymer liquid into the cut and sheathed fiber bundle through either or both ends to produce hardened pen nib portion.

As stated above, the present invention enables mass production of the sign pen in a simpler process and in a much shorter time without assembly of parts, and produces a nib pen of good appearance.

BRIEF DESCRIPTION OF THE DRAWING

The present invention will now be described with reference to the drawings illustrating several preferred embodiments in which.

DESCRIPTION OF THE PREFERRED EMBODIMENTS

Figure 1:
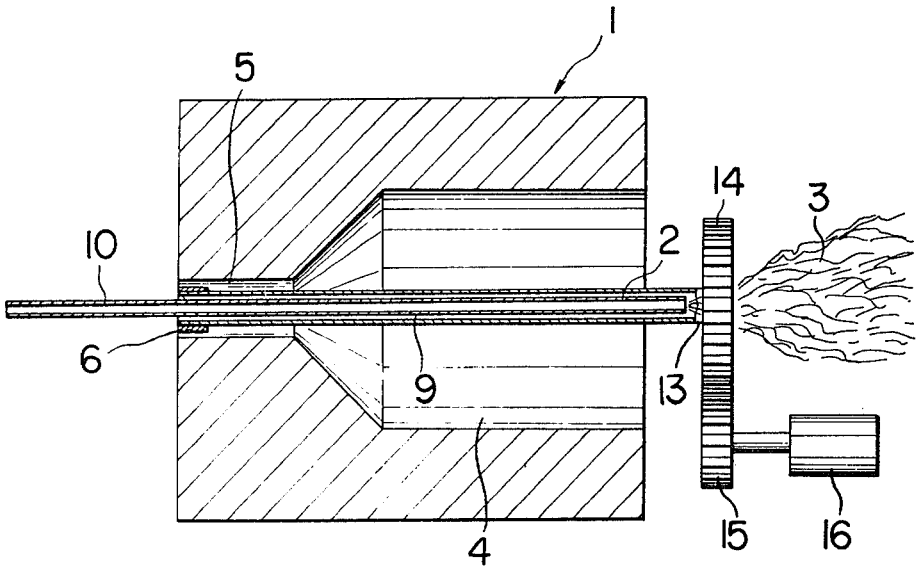
FIG. 1 is a schematic cross-sectional view of an extruder for manufacturing the pen material.

The pen material may be manufactured by means of an extruder 1 schematically illustrated in FIG. 1. The extruder performs a complex extrusion wherein a sheath as well as a fiber bundle providing ink reservoir and pen nib portion are simultaneously extruded to coat the former around the latter.

Fibers 3 such as polyester are fed into a fiber feeding means 2 centrally disposed in the extruder 1 to form a fiber bundle 8. At the same time suitable synthetic resin such as vinyl chloride is supplied into an extruding and coating means 4 through a feeder (not shown), and is melted are extruded through an extruding port 5. The extruding port 5 includes a die 6 disposed thereon and shaped for the formation of a groove within the thickness of the sheath material at the time of extrusion. For this purpose, the die 6 at least one projection formed thereon.

Figure 2:
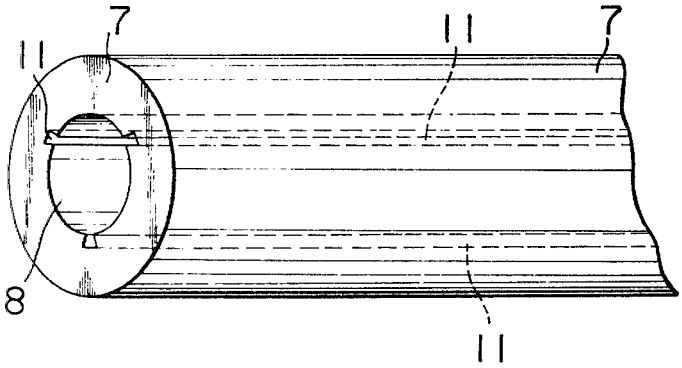
FIG. 2 is a perspective view of the pen material including linear grooves formed in the sheath.
Figure 3:
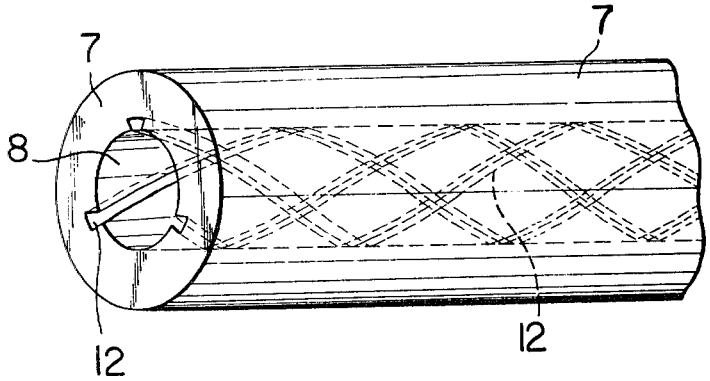
FIG. 3 is a perspective view of the pen material including spiral grooves formed in the sheath.

The extrusion by use of the die 6 on the extruder 1 illustrated in FIG. 1 produces the sign pen material shown in FIGS. 2 and 3. The embodiment shown in FIG. 2 is manufactured without rotation of the die 6 and the embodiment shown in FIG. 3 is manufactured with rotation of the die 6. By cutting these to a desired length the pen material is provided.

The fibers are supplied to the feeding means 2 through an anti-rotation means 9 and further through its extension 10 to form the fiber bundle, and met and bonded with the hot extruded sheath at an area just forward of the extension. The sheath is extruded through the extruding port 5 in a given thickness and the die 6 disposed on the extruding port 5 may shape the linear grooves 11 shown in FIG. 2 or the spiral grooves 12 shown in FIG. 3 within the thickness of the sheath and on its interior. The feeding means 2, which includes the anti-rotation means 9 as well as its extension 10 are preferably made of a low friction material, for example, a fluoride resin. Thus, the fibers flow smoothly through the fluoride resin cylinder, thereby avoiding alternate formation of thick-thin portions in the fiber bundle, and furthermore preventing rotation of the cylinder together with the groove forming means as it rotates. The prevention of rotation may also be realized by interposition of a fixed tube between the anti-rotation means and the rotating member.

In case of forming the linear groove 11, the groove forming means should not be rotated. The fiber bundle and the sheath are extruded linearly and they meet together at the extreme end of the extension 10 to be bonded.

In case of the formation of the spiral groove 12, as shown in FIG. 1, cylinder 13 on which is mounted the die 6 serving as the groove formation means, is provided at its opposite end with a gear 14 which is connected through a reduction gear train 15 to a motor 16.

The groove may also be formed on the periphery of the fiber bundle in place of in the sheath, however it is preferable to form the groove in the sheath because of the resiliency of the fiber bundle itself. In order that the fibers do not enter to clog the groove, it was found best that the shape of the groove should have a cross-section which includes a small opening at the interior of the sheath, the cross-sectional area, progressively expanding away from the opening and closing without reaching the outside of the sheath. This arrangement indeed substantially reduces the amount that the fiber may enter into the groove, but some entry of fiber into the groove is unavoidable as the direction in which the fibers are disposed is nearly parallel to the direction of the groove. However, a spiral groove hardly permits the entrance of any fiber into the groove. The sheathed fiber bundle thus extruded is cut into desired lengths of pen material 17. Into these sheathed fiber bundles, urethane prepolymer liquid is injected through either or both ends thereof to form the hard sign pen nib portion or portions. Urethane prepolymer means a mixed polymer which mainly includes at least one polyol and at least one isocyanate, and which produces polyurethane upon reaction of its constituents. For example, by use of an apparatus schematically shown in FIG. 4 the injection into bundles of the pen material 17 may be performed. The injecting apparatus includes at least one injecting nozzle 18, a container 19 for pressurized urethane prepolymer liquid, pipes 20 for connecting said nozzles to the container, and a timer-controlled valve 21 interposed in the pipes 20. Then, by controlling the dimension of the pipe, the pressure of urethane prepolymer liquid, and/or the opening time of the timer-controlled valve, the amount of the injection into the sign pen material may be changed in any manner as required.

Figure 5:
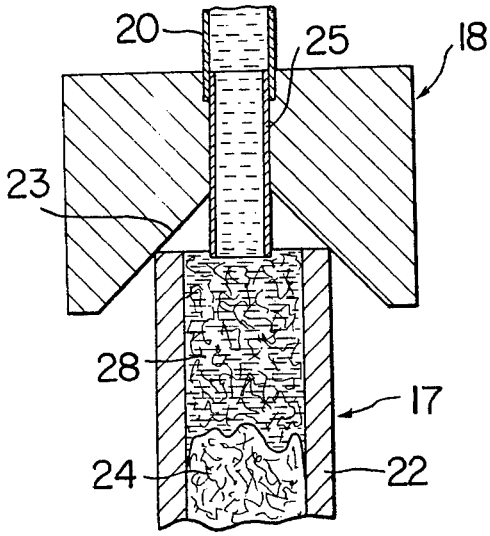
FIG. 5 is an enlarged sectional view wherein the injection of urethane prepolymer liquid into the fiber bundle of the pen material is performed.
Figure 4:
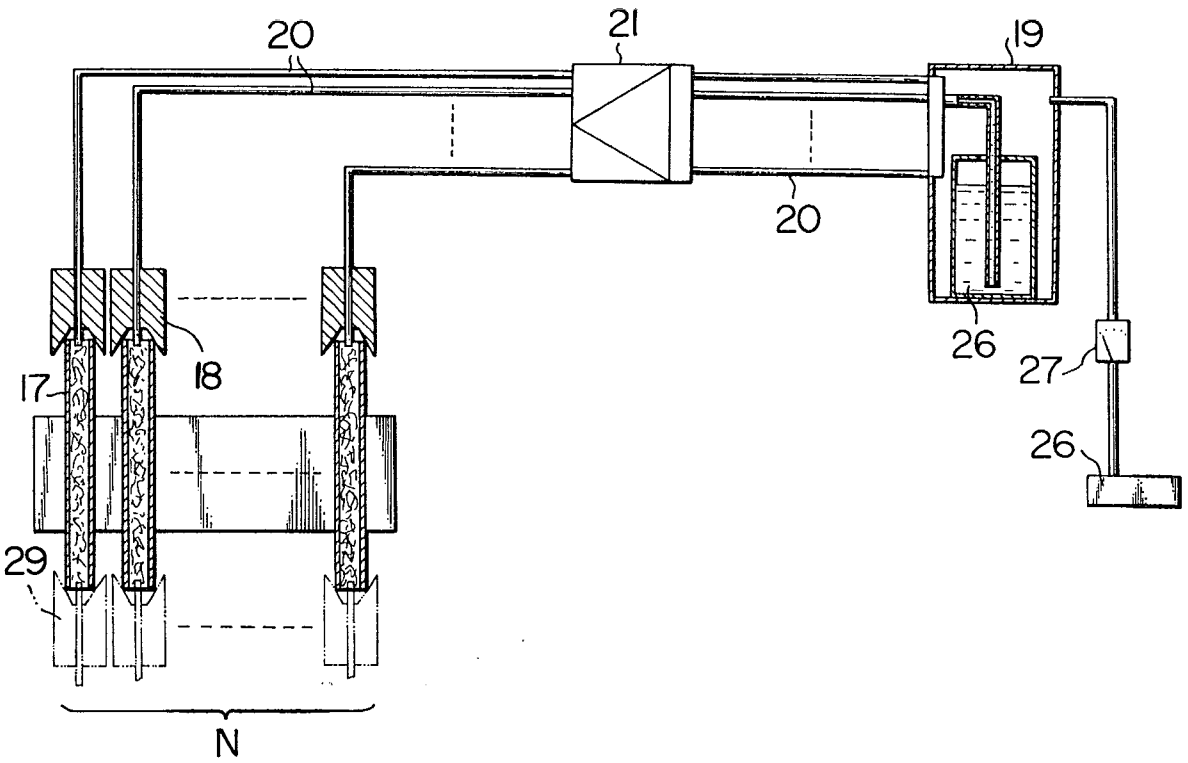
FIG. 4 is a schematic view of an apparatus for injecting urethane prepolymer liquid into the fiber bundle of the pen material.

In injection, the injecting nozzle 18 is moved to abut against the sign pen material 17 as shown in FIG. 4. The condition in which the nozzle is abutted against the pen material is illustrated in an exaggerated manner. As shown in FIG. 5, a taper 23 of the injecting nozzle 18 first contacts the end of the sheath 22 of the pen material to center same. Thus, the fiber bundle portion 24 always abuts against an injecting pipe 25 of the injecting nozzle 18. After abutment the valve is opened by control of the timer therein to inject urethane prepolymer liquid 26 through pipes 20 and 25 into the fiber bundle 24. The liquid to be injected is preferably kept at a constant pressure, for example, by means of a compressor 26 and a pressure regulator 27 shown in FIG. 4. The fiber bundle portion into which liquid was injected is illustrated as the shaded area 28 in FIG. 5. This shaded portion provides the hard writing nib portion by a subsequent machining operation.

The method of forming the pen nib portion by injection according to the present invention offers great improvements in productivity and appearance of the sign pen in comparison with the conventional dipping method described in previously mentioned patents. Injection of liquid into both ends of the pen material, which was very troublesome in the conventional dipping method, is in a simple way solved by arrangement of a pair of injecting nozzles at opposite ends of the pen material 17 as illustrated by broken line 29 in FIG. 4.

The sign pen will be finished by machining the hardened fiber bundle portion 28 to a desired shape.

I claim:

1. A method of manufacturing a writing pen having a completely integral writing nib portion and ink reservoir, comprising the steps of:

passing fibers through a die to compress and form them into a fiber bundle;

extruding a plastic sheath around said fiber bundle;

cutting the sheathed fiber bundle thus formed into a predetermined length;

injecting urethane prepolymer liquid under pressure into either or both ends of the cut and sheathed fiber bundle to impregnate same;

allowing the urethane polymer to harden; and machining the impregnated end portions to a suitable shape.

2. The method of claim 1 wherein said elongated air passage is formed by forming a groove in the inner surface of said sheath during extrusion of the sheath.

3. The method of claim 2, wherein said step of forming said groove shapes said groove so that the width of said groove is small at the surface of said sheath and expands to a wider width in the interior of said groove.

4. The method of claim 1 wherein said elongated air passage is formed by forming a groove in the periphery of the fiber bundle during passage through the die.

5. The method of claim 1 in which the cut and sheathed bundle is centered in a tapered injection nozzle for injection of the urethane prepolymer.

6. The method of claim 1 comprising the further step of forming an elongated air passage extending lengthwise along the surface of said bundle between said sheath and said bundle.

* * * * *